US005562138A

United States Patent [19]

Hofacker

[11] Patent Number: 5,562,138

[45] Date of Patent: Oct. 8, 1996

[54] BOWING PRESS

[75] Inventor: Chauncey Hofacker, St. Louisville, Ohio

[73] Assignee: The Longaberger Company, Dresden, Ohio

[21] Appl. No.: 322,915

[22] Filed: Oct. 13, 1994

[51] Int. Cl.[6] ..... B27H 1/00

[52] U.S. Cl. ..... 144/381; 144/256.1; 144/266; 144/348; 144/349; 144/380; 156/443; 156/196

[58] Field of Search ..... 144/256.1, 254, 144/266, 267, 270, 271, 380, 381, 346, 349, 352, 348; 156/323, 443, 196

[56] References Cited

U.S. PATENT DOCUMENTS

| | | | |
|---|---|---|---|
| 546,052 | 9/1895 | Palmer | 144/256.1 |
| 710,231 | 9/1902 | Aber | 144/256.1 |
| 973,401 | 10/1910 | Bailey | 144/256.1 |
| 1,757,779 | 5/1930 | Navratil | 144/259 |
| 2,502,460 | 4/1950 | Jordan | 144/266 |
| 3,027,923 | 4/1962 | Schreiber | 144/256.1 |
| 4,967,816 | 11/1990 | Postema | 144/266 |
| 5,293,961 | 3/1994 | Postema | 156/443 |

OTHER PUBLICATIONS

S. Williford, "The Longaberger Story", 1991, p. 88.

*Primary Examiner*—W. Donald Bray
*Attorney, Agent, or Firm*—Porter, Wright, Morris & Arthur

[57] ABSTRACT

A bowing press apparatus which includes a subassembly. The subassembly comprises a housing, a mandrel supported by the housing, a wiper plate connected to said housing and capable of pivoting with respect to said mandrel, and an actuator that exerts a force against the wiper plate, causing the wiper plate to pivot. An overbender capable of pivoting with respect to the mandrel and the wiper plate may be connected to the wiper plate. An actuating device that exerts a force against the overbender and causes it to pivot also may be included.

40 Claims, 3 Drawing Sheets

BOWING PRESS

BACKGROUND AND SUMMARY OF THE INVENTION

The present invention is concerned generally with a bowing press, and particularly with a bowing press for shaping an article including natural fibers.

It frequently is desirable to form substantially flat articles into a bowed shape for functional or decorative purposes. When the article to be shaped includes natural fibers, a risk exists that the bowing will damage the fibers, resulting in splintering or other undesirable conditions.

Articles including natural fibers, such as hardwood splints, may be formed into a bowed shape manually. For example, the article may be wetted to increase its pliability, manually bent into conformance with a mold or other shaping device, secured in this conforming position, and allowed to dry.

Manual bowing methods have numerous disadvantages. The manual bending of the article may be physically difficult to accomplish, particularly when this task is to be performed repeatedly. In addition to the physical difficulty of the manual forming and the risk of acute injury associated therewith, repetitive motions, such as those associated with manual bowing methods, may result in chronic injury in some individuals.

Manual bowing methods also may increase the difficulty of assigning tasks to members of a team responsible for carrying out this and other tasks. Not all members of the group may be capable of performing manual bowing methods, so this factor must be taken into consideration when assigning team members to particular tasks. Thus, the use of manual bowing methods not only reduces flexibility in task assignment, but also may adversely affect the morale of team members.

Articles bowed by manual methods are susceptible to damage during the bowing process. The force necessary to conform an article to a shaping device may not be applied uniformly across the bowed portion, resulting in breakage of the fibers and splintering. The likelihood of fiber damage increases with the angle desired in the shaped object. The presence of irregularities or flaws, such as knots, in the articles to be bowed also increases the likelihood of fiber damage during bowing. Such fiber damage may adversely affect the strength or appearance of the bowed object, resulting in the waste of both raw materials and labor.

Manual bowing methods also are slow and imprecise. Generally, each article must be bowed individually. If the articles are not carefully and fully conformed to a shaping device, the resulting bowed objects may vary from one another in an unacceptable manner.

In addition, manual bowing methods typically require that separate molds be formed for each particular bowed shape desired. These molds are costly to produce and bulky to handle and store. Molds made of wood also are susceptible to physical damage from the stresses of manual bowing as well as to deterioration over time when these molds are used to bend articles that must be wetted before bowing.

An object of this invention is to provide an apparatus and method for bowing articles that reduces the physical demands associated with manual bowing methods.

A second object of this invention is to provide an apparatus and method for bowing articles that is less labor intensive than manual bowing methods.

A third object of this invention is to provide an apparatus and method for bowing articles that is faster than manual bowing methods.

A fourth object of this invention is to provide an apparatus and method for bowing articles in which numerous objects may be bowed in a single operation.

A fifth object of this invention is to provide an apparatus and method for bowing articles that results in consistent, uniformly shaped objects.

A sixth object of this invention is to provide an apparatus and method for bowing articles that decreases damage to the articles during bowing, particularly when the articles include natural fibers.

A seventh object of this invention is to provide an apparatus and method for bowing articles in which the articles to be bowed are supported upon a substrate during bending of the articles.

An eighth object of this invention is to provide an apparatus and method in which the force exerted against the article to be bowed during bending is applied more uniformly.

Another object of this invention is to provide an apparatus and method for bowing wooden articles that reduces the scrap rate associated with manual bowing methods.

Yet another object of this invention is to provide an apparatus and method that requires fewer types of molds or shaping devices than conventional bowing methods, that provides more compact shaping supports for bowing an article, and that provides a shaping support for bowing an article that is more resistant to physical damage than conventional shaping supports.

Still another object of this invention is to provide an apparatus and method in which the drying time of bowed objects formed from articles that require wetting before bowing is decreased.

The present invention provides an apparatus and method for bowing articles that is faster, less labor intensive, and less physically-demanding than manual bowing methods. The apparatus and method of the invention permit the bowing of numerous articles in a single operation and yield consistent, uniformly shaped bowed objects.

The present invention provides an apparatus and method in which pressure is exerted more uniformly upon the article to be bowed, thereby reducing damage to articles during bowing, and particularly to articles that include natural fibers. The present invention also provides an apparatus and method for bowing articles that decreases the scrap rate and permits bowed objects to be formed successfully from articles containing minor flaws or irregularities, such as knots, that would interfere with manual bowing methods.

The apparatus and method of the present invention reduce the number of different shaping supports required to produce bowed objects having a variety of sizes and configurations when compared to manual bowing methods. The present invention also provides shaping supports that are less bulky and easier to store than conventional molds or shaping devices. The present invention also reduces the drying time of bowed objects formed from articles that require wetting before bowing to increase their pliability.

The foregoing objectives are achieved in a bowing press apparatus that includes at least one subassembly. The subassembly is comprised of a housing, a mandrel supported by the housing, a wiper plate connected to the housing and capable of pivoting with respect to the mandrel, and an actuator that exerts a force against the wiper, causing the wiper plate to pivot. The apparatus may be used as follows. A support bearing a substrate is positioned between the mandrel and the wiper plate. The wiper plate is then rotated in relation to the mandrel to conform the supported substrate to a portion of the mandrel. The supported substrate is then removed from engagement with the mandrel. The apparatus may also include a second subassembly which is substantially similar to the first subassembly and is capable of movement in relation to the first subassembly.

DETAILED DESCRIPTION OF THE PREFERRED EMBODIMENT(S)

The bowing press apparatus of the present invention incorporates two subassemblies that act in concert during a press cycle to form a material into a desired shape. Each subassembly is substantially identical, with some exceptions noted herein. The following detailed description illustrates one subassembly and its composition, but is equally applicable to both subassemblies. It will be appreciated that minor changes may be made to the apparatus to facilitate molding various materials into different shapes.

Figure 1:
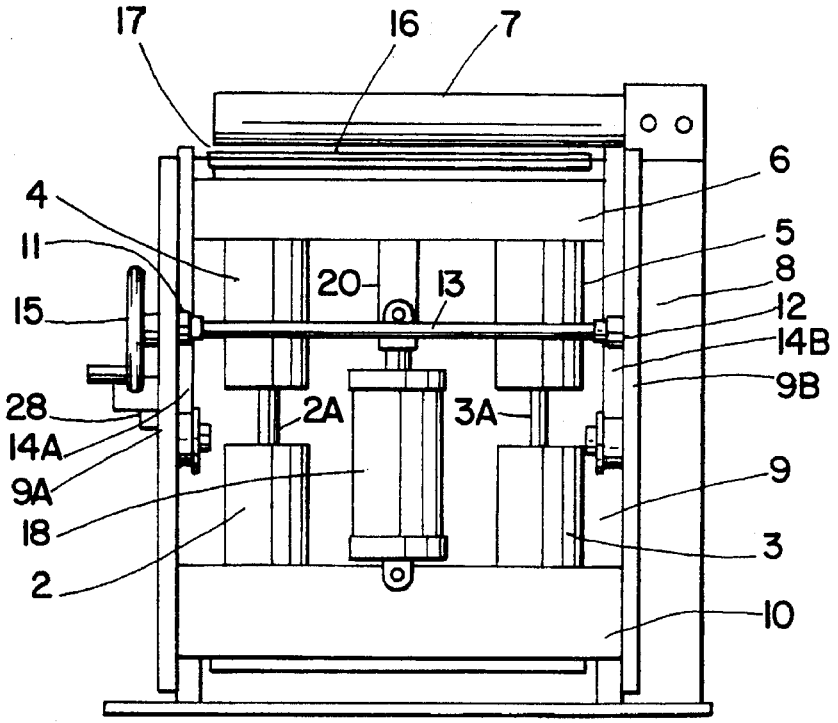
FIG. 1 shows a side view of the bowing press apparatus.

Referring now to the drawings, FIG. 1 shows a side view of subassembly 1 of the apparatus. Cylinders 2 and 3 are located within housing 9 and communicate with a pinch plate support frame, which includes cylinder rods 2A and 3A, drives 4 and 5, and pinch plate 6. Housing 9 includes at least two upwardly extending walls 9A and 9B. A pressure source and regulators (not shown) are used to actuate all the cylinders within the apparatus. The pressure source is connected to the various cylinders by way of a flexible conduit. The placement of this conduit is conducive to both user safety and convenience and provides satisfactory pressure for initiating each cylinder. In the preferred embodiment, all of the cylinders are pneumatic. However, hydraulic cylinders or like devices capable of exerting a sufficient force in a specified direction may be used. In the present configuration, the noise factor was considered in selecting pneumatic cylinders because the device is typically used on a factory floor where loud noise is commonplace; thus, any reduction in noise without loss of performance is desirable.

Mandrel 7 is supported at one end by mandrel support 8, which is connected to upwardly extending subassembly wall 9B. Subassembly 1 further includes a gear rack assembly defined by gears 11 and 12, which are mounted on gear rack 13 and communicate with side rails 14A and 14B, respectively. Hand brake 15 employs a disk brake locking mechanism and is connected to housing wall 9A. Cylinders 2 and 3 are connected to the housing by way of bottom cylinder support 10. These cylinders lift the pinch plate frame vertically to act as a vise for securing a tray against mandrel 7.

Figure 2:
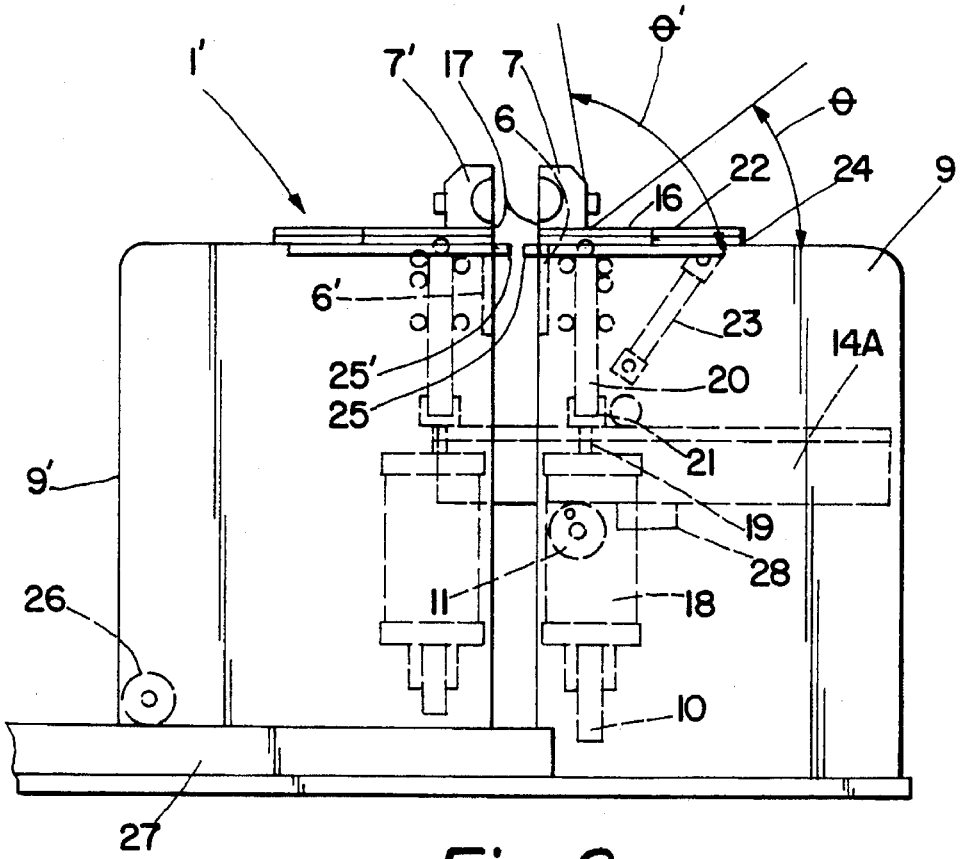
FIG. 2 illustrates a front view of the bowing press apparatus.

Turning now to FIG. 2, a front view of the bowing press apparatus is shown. The press incorporates two subassemblies 1 and 1' which act together during a press cycle. Pneumatic cylinder 18 is fixedly connected to the housing by way of bottom cylinder support 10. Bending piston rod 19 protrudes upwardly from cylinder 18 and is connected to drive shaft 20. The bending piston transmits a force exerted by pneumatic cylinder 18 against the wiper 16 and/overbender 22. Alignment guide 21 is attached to bending piston 19, which acts to prevent deflection of the force provided by cylinder 18. Accordingly, piston 19 must be composed of a material capable of withstanding and transmitting a force exerted by cylinder 18. By way of example, pneumatic cylinder 18 may have a six (6) inch bore and may be capable of exerting a force of approximately 4000 pounds per square inch.

Figure 3A:
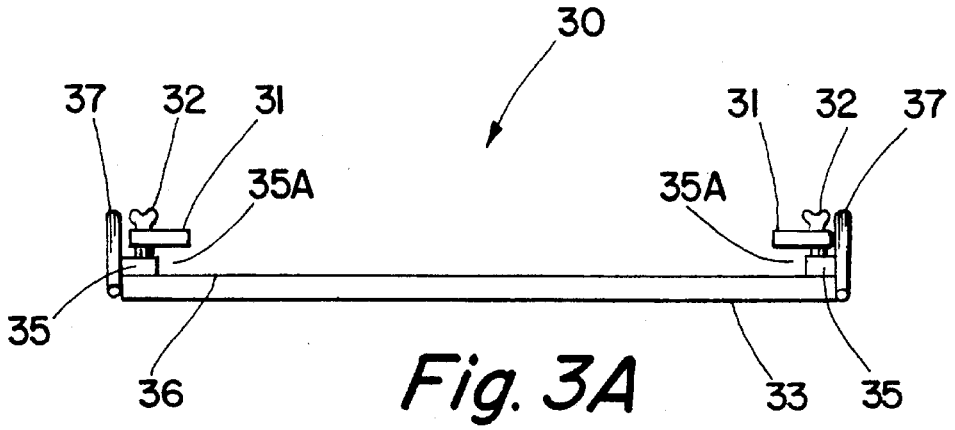
FIG. 3A is a side view of a tray in the present invention.
Figure 3B:
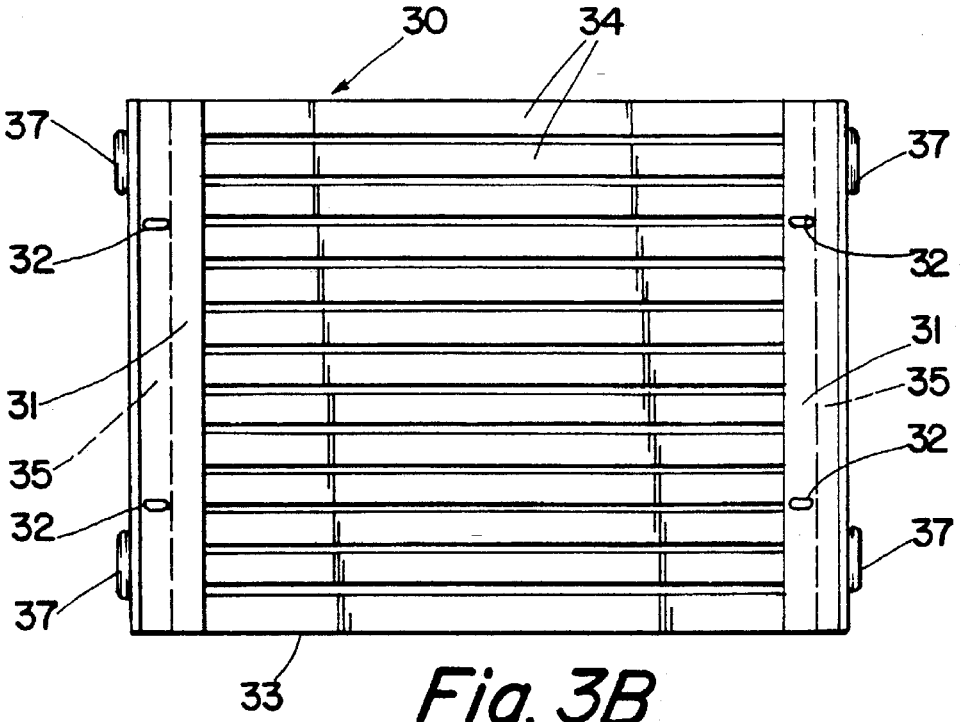
FIG. 3B is a top view of the tray in the present invention.
Figure 3C:
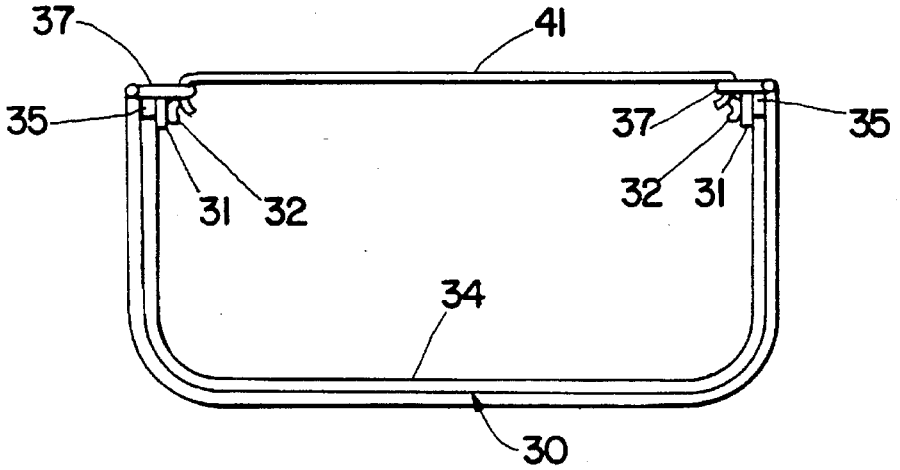
FIG. 3C is a side view of a tray and bracket combination after a press cycle is complete.

The horizontal planar surface of the press is defined by wiper plate 16 and overbender 22. One end of overbender 22 is positioned adjacent to the outer longitudinal side of wiper plate 16. The wiper plate is pivotally attached at its other end to the pinch plate support frame and is positioned beneath and extends longitudinally and substantially parallel to mandrel 7. When the press is in an inactive station, wiper plate 16 and mandrel 7 define a space therebetween for insertion of a forming tray (as shown in FIGS. 3A, 3B and 3C). The wiper plate has a smooth durable surface which provides low resistance to sliding movement of a tray.

The wiper plate and overbender are both rigid members which have an inactive and an active station. In the inactive station, the wiper plate and overbender define a substantially horizontal plane. A tray loaded with articles to be bowed is placed on this plane before beginning a press cycle. As the press is activated by a user, pistons 2 and 3 (shown in FIG. 1) force the pinch plate frame, comprising cylinder rods 2A and 3A, drives 4 and 5 and pinch plate 6, upward toward mandrel 7. Wiper plate 16 and overbender 22 are displaced as a unit upward toward mandrel 7 by way of piston 18, which forces crankshaft 20 upward. Initially, the wiper plate and overbender are displaced linearly toward mandrel 7. As the tray overlaying the wiper plate comes into contact with the mandrel, the wiper plate ceases to move linearly and is displaced pivotally by way of piston 18 and crankshaft 20. The wiper plate and overbender pivot radially along angle $\Theta$ relative to the press's horizontal plane. Angle $\Theta$ may vary depending on the curvature desired in the material to be bowed. When the wiper plate reaches angle $\Theta$, its movement ceases and overbender 22 continues pivotally and radially along angle $\Theta'$ by way of an additional pneumatic cylinder 23. This pneumatic cylinder is connected to a "U" shaped frame 24 containing a trunnion plate which maintains a constant angle relative to overbender 22 and allows the cylinder to move with wiper plate 16 to angle $\Theta$ where cylinder 23 is activated. The "U" shaped bracket 24 imparts the cylinder's force directly onto overbender 22, thereby eliminating deflection. The overbender continues its radial movement to a desired angle $\Theta'$. Thus, the forces exerted onto the tray induce it to bend around the axial radius of mandrel 7 which results in the desired shape of a tray's contents.

By way of example, wood splints may be placed in a tray to form basket handles of a shape illustrated in FIG. 3C. The tray containing a plurality of wood splints is placed in the press and rests upon wiper plate 16 and overbender 22. Upon activation, piston 18 applies a force which displaces the tray linearly upward toward mandrel 7 until the wood splints come into contact with the mandrel. Pistons 2 and 3 force pinch plate 6 upwardly which assists in securing the tray's contents against the mandrel. However, this is not the only securing means employed in the press. Wiper plate 16 and overbender 22 are displaced by piston 18 and drive shaft 20, rotatably along angle Θ. To achieve the handle shape in FIG. 3C, Θ is approximately 32 degrees. Upon reaching angle Θ, cylinder 23 is actuated, displacing overbender 22 along angle Θ'. For the handle shape in FIG. 3C, Θ' is approximately 100 degrees. It should be noted that the shape of the mandrel used can vary, thereby allowing the tray's contents to be pressed in a particular configuration. Moreover, various pneumatic cylinders may be used that are capable of imparting forces which bend more rigid material than wood splints. In addition, to alter the bending configuration, the space between each subassembly may also be changed.

Returning to FIG. 2, bow guides 25 and 25' project into the space defined between subassemblies 1 and 1' and are fixedly connected to pinch plates 6 and 6', respectively. As wiper plate 16 reaches angle Θ, and as overbender 22 reaches angle Θ , downward forces are exerted onto a tray at the points where the tray rests on the bow guides. Each bow guide opposes the downward force exerted against the tray during bending, thereby preventing excessive or undesirable bowing of the center portion of the tray's contents during a press cycle. Similarly, the operation described above is performed substantially simultaneously with respect to subassembly 1'.

The movement of one subassembly relative to the other provides a means for changing the configuration of the material to be bent, as well as releasing tension between a tray and mandrels 7, 7', to allow the tray to be removed from the press after a cycle has been completed. This movement may be accomplished, by way of example, by the gear rack assembly described with reference to FIG. 1. A first end of side rail 14A is fixedly attached to housing wall 9A of subassembly 1. A second end of side rail 14A is attached to housing 9A of subassembly 1'. A first end of side rail 14B is fixedly attached to housing wall 9B of subassembly 1'. A second end of side rail 14B is attached to housing wall 9B of subassembly 1'. Hand brake 15 locks subassemblies 1 and 1' in position during press operation. Presently, brake 15 is a hand disc brake, but it may assume alternative configurations. The movement of subassembly 1' along the gear rack assembly may be assisted, for example, by an additional pneumatic cylinder 28 which provides a force when activated by a user. Subassembly 1' has two flange wheels, illustrated by flange wheel 26, on each side of the subassembly that are reinforceably attached to each housing wall. Flange wheel 26 may communicate with flange rail 27 to provide a low coefficient of friction with respect to the movability of subassembly 1'. Thus, pneumatic cylinder 28 can exert a relatively small force to assist displacement of subassembly 1'. The apparatus may also be constructed whereby each subassembly is moveable, and thus, the preceding gear, gear rack, and hand brake elements, in some combination, would apply to each subassembly.

Turning now to FIG. 3A, which is a side view of forming tray 30, the tray 30 includes a tray body 33 having an upper surface 36. The tray body 33 is formed from a flexible but durable composition, such as stainless steel. Preferably, the tray is resistant to liquids and is capable of withstanding temperatures at least as high as 160 ° F. FIG. 3B is a top view of a tray 30 having a substantially rectangular shape, but other configurations also may be suitable. An eye 37 or other fastener-receiving device may be provided on opposing sides of the tray 30 for use in securing the ends of the bowed tray to one another. Preferably, the eyes 37 project transversely from the tray surface.

Retainers 31 are arranged parallel to left and right edges of the tray body 33 and are maintained at a desired distance above the tray body 33 by spacers 35. The retainers 31 overhang the spacers 35 (as illustrated in FIG 3A). The height of the spacers 35 corresponds to the thickness of the articles to be bowed so that the ends of the article may be inserted into the slots 35A defined by the retainers 31 and the tray body 33. Although a particular spacer height may accommodate articles that vary slightly in thickness, a differently-sized spacer may be required to accommodate large variations in thickness.

A retainer 31 may be movably connected to a spacer 35 by a fastener 32. Preferably, the fastener 32 is inserted through a slot or bore (not shown in the drawings) provided in the retainer 31 and extends into spacer 35 such that retainer 31 is capable of moving from a first position to a second position relative to the tray body 33. When the retainer 31 is provided with a slot arranged perpendicular to or diagonally with respect to its longitudinal dimension, the retainer 31 may slide from an inward position suitable for securing articles within the tray to an outward position suitable for releasing the objects from the tray 30. Alternatively, when a retainer 31 is provided with a slot arranged parallel to the retainer's longitudinal dimension or with a substantially circular bore, the retainer 31 may slide vertically along the shaft of the fastener 32 from a lower position suitable for securing articles within the tray 30 to an upper position suitable for releasing articles from the tray 30. The retainer 31 also may be pivotably connected to the tray to define an active and an inactive position. In its active position, the retainer engages the tray's contents; in its inactive position, the retainer is displaced radially away from the tray's contents to facilitate release of the tray's contents.

Upon completion of a press cycle, the tray and its contents are bent about the mandrel. As explained above, the tension between the tray and the mandrel must be released before the tray 30 can be removed. This may be accomplished by activating the pneumatic cylinder 28, which allows subassembly 1'to be displaced toward subassembly 1 by way of the gear rack assembly, as shown in FIG. 2. The displacement of subassembly 1' releases the retention pressure exerted on the tray by the mandrel combination so that the tray may be removed easily. After the pressure is released, subassembly 1' returns to its original position with the press plate frame and the wiper plate/overbender combination in their inactive stations, in preparation for the beginning of another pinch cycle.

Figure 4:
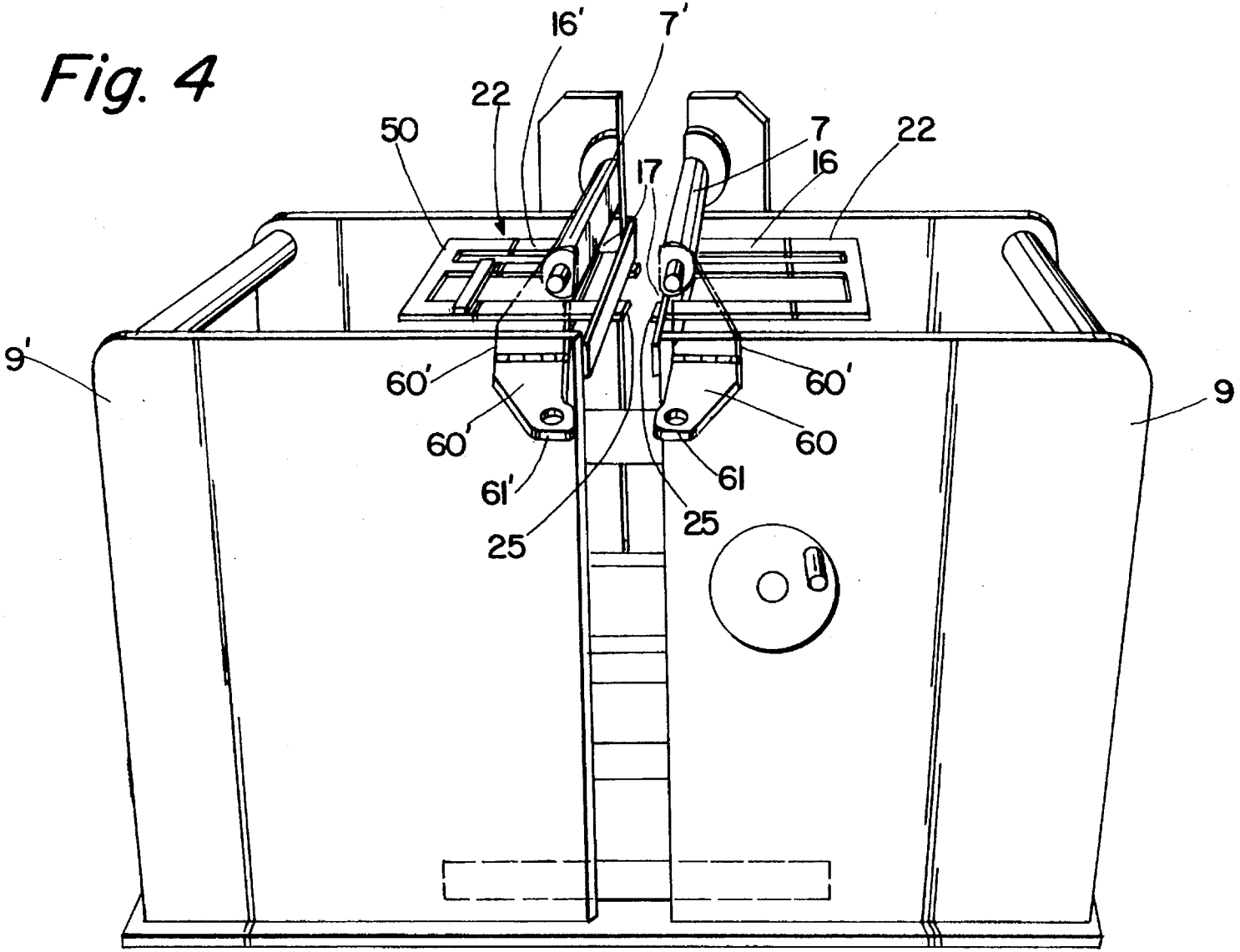
FIG. 4 is a perspective view of both subassembies of the present invention.

FIG. 4 is a perspective view of the press. A tray is placed on the press in space 17 whereby mandrels 7 and 7' act as fulcrum points around which the tray is bent. To facilitate proper tray placement, tray stopper 50 is connected to the upper surface of an overbender at a specified distance from a bow guide 25, 25'. A tray end abuts the tray stopper, assuring a user that the tray is positioned correctly. As different sized trays are used, the tray stopper may be adjusted accordingly on the overbender 22, 22'. A rear tray stopper may also be provided, for example, on wiper plate 16, 16' or overbender 22, 22', to guide placement of the rear of a tray.

Mandrel support locks 60 and 60' are also illustrated in FIG. 4. The locks provide support for the free ends of the mandrels during press operation. Each lock has an active and an inactive station. The active station is depicted by the dashed outline of the locks and the inactive station is depicted by the solid lines. Locks 60 and 60' are pivotally connected to housings 9 and 9' respectively. The lock include receiving cavities 61 and 61' which have cross-sectional dimension slightly greater than the cross-sectional dimensions of each mandrel. In its inactive station, each lock hangs at or below the horizontal plane of the press. After loading a tray, the locks may be placed in their active station whereby each cavity 61 and 61' receives a free end of a mandrel or an extension thereof. After the press cycle is complete, the locks may be returned to their inactive station and the tray may be removed.

The apparatus of the present invention may be used as described below. This description assumes that more than one article will be bowed in a single operation. However, the apparatus and method of the present invention also may be used to bow a single article, provided the width of the article is slightly less than the width of the forming tray and the length of the article is no more than slightly longer than the length of the forming tray.

Before loading the articles to be bowed into a forming tray, the articles may be wetted to increase their pliability. The wetting may be accomplished by immersing the articles, such as wood splints, in water or another suitable softening medium. The immersion time and water temperature may be adjusted depending on such factors as the type, condition and thickness of the article to be bowed, the bowing angle desired, and whether discoloration of the resulting bowed object is undesirable in a particular application. Preferably, wetted objects will be loaded into the forming trays as soon as possible after they are removed from the water. If the articles to be bowed are sufficiently pliable, however, wetting may not be required.

The splints or other article to be bowed may be loaded onto the forming tray 30 in substantially abutting parallel relationship, as shown in FIG. 3B. The opposing ends of the articles are inserted into the slots 35A defined by the retainers 31 and the tray body 33. When a desired number of objects has been loaded into the tray 30, the tray may be inserted into the bowing press with the tray 30 overlaying the wiper plates 16, 16' and the overbenders 22, 22'. The tray is bent about the mandrel into a desired configuration, an example of which is illustrated in FIG. 3C. While maintaining this bent position, a tray bracket 41 is fastened between eyes 37 to secure the opposing ends of tray 30 to one another. After the tray bracket is inserted and pressure exerted on the tray is released as a result of the displacement of subassembly 1', the tray may be removed from the press.

After the press cycle has been completed and the bowed tray has been removed from the bowing press as described above, the tray and its contents may be set aside to rest and, if the splints have been wetted, to dry. If the splints have been wetted, the bowed tray may be inverted during drying so that the tray edges rest on the supporting surface to assist in draining water away from the tray contents. The optimum time and temperature for resting and drying may vary with the composition and thickness of the bowed objects. If the bowed objects are not permitted sufficient resting or drying time after bowing, the bowed objects will not retain the desired shape after they are removed from the forming tray, but instead will tend to open up into a less bowed shape. This tendency may be obvious immediately after the objects are released from the tray. If the bowed objects remain within the tray for an extended period after the bowing process, the risk of damage to the bowed objects during removal from the tray increases.

Bowed objects 34 may be released from the tray as follows. The tray bracket 41 is removed from the tray eyes 37 shown in FIG. 3C. The fasteners 32 that extend through the retainers 31 and into the spacers 35 may be loosened along one edge of the tray 30. When these fasteners 32 are loosened, the retainer 31 may be moved away from the tray body 33, freeing an end of the bowed objects from the slot 35A between the retainer 31 and the tray surface 36. The other end of the bowed objects then may be moved out of the slot 35A on the other edge of the tray 30.

By way of example, the apparatus and method of the present invention may be used to bow hardwood splints to form basket handles. For example, thin maple splints in the range of about ⅜-inch thick may be immersed for a minimum of about 10 to 15 minutes in water, preferably maintained at a temperature of about 140° to about 160 ° F. Immersion for periods of more than about 25 minutes is likely to result in discoloration of the splints.

FIG. 3C is an end view of a bowed tray of splints that have been formed into a configuration desirable for basket handles. Trays holding bowed handles formed from wetted maple splints typically are dried in an area having good air circulation and a temperature of up to about 160° F. for about 7 hours. When the resulting bowed handle remains in a forming tray for more than about 12–14 hours, the risk of cracking of the splints increases.

Although a specific embodiment of the invention has been described herein in detail, it is understood that variations may be made thereto by those skilled in the art without departing from the spirit of the invention or the scope of the appended claims.

What is claimed is:

1. A bowing press apparatus comprising at least one subassembly, said subassembly comprising:

a housing;

a mandrel supported by said housing;

a wiper plate connected to said housing said wiper plate defining a substrate-supporting surface, said wiper plate pivotally moveable relative to said mandrel; and an actuator engaging said wiper plate and causing said wiper plate to pivot.

2. The apparatus of claim 1, further comprising:

an overbender connected to said wiper plate, said overbender pivotally moveable relative to said mandrel and said wiper plate.

3. The apparatus of claim 2, further comprising:

an actuating device engaging said overbender and causing said overbender to pivot.

4. The apparatus of claim 1, further comprising:

a gear assembly capable of facilitating movement of said subassembly, said gear assembly including:

(i) first and second side rails each connected to said housing;

(ii) a gear rack connected to said housing and transversely communicating with said first and second rails; and (iii) a locking mechanism connected to said housing, said locking mechanism releasibly engaging said gear rack and securing said subassembly in a desired position relative to said rails.

5. The apparatus of claim 1, wherein said actuator is a pneumatic cylinder.

6. The apparatus of claim 1, further comprising:

a tray removably communicating with said wiper plate, said tray releasibly retaining an article to be bowed.

7. The apparatus of claim 6, wherein said tray is flexible.

8. The apparatus of claim 6, wherein said tray is resistant to liquids.

9. The apparatus of claim 1, further comprising:

a pinch plate connected to said housing in a position transversely separated from said mandrel, said pinch plate supporting a tray in communication with said wiper plate.

10. The apparatus of claim 9, further comprising:

a piston device engaging said pinch plate and causing said pinch plate to move linearly with respect to said mandrel.

11. The apparatus of claim 9, further comprising:

a bow guide connected to said pinch plate, said bow guide further supporting the tray.

12. The apparatus of claim 2, further comprising:

a tray stopper adjustably attached to said overbender.

13. The apparatus of claim 2, further comprising:

a mandrel support lock having a mandrel-receiving cavity, said support lock pivotally connected to said housing, said lock having an active station in which said support lock extends above a horizontal surface defined by said wiper plate and said overbender and an end of said mandrel is received within said cavity, and an inactive station in which said support lock is positioned at or below said horizontal surface to allow a tray to be placed into and removed from communication with said horizontal surface.

14. The apparatus of claim 3, wherein said actuating device is a pneumatic cylinder.

15. A bowing press apparatus, comprising:

a first subassembly including a housing, a mandrel supported by said housing, a wiper plate connected to said housing, said wiper plate pivotally moveable relative to said mandrel, and an actuator engaging said wiper plate and causing said wiper plate to pivot; and a second subassembly including a housing, a mandrel supported by said housing, a wiper plate connected to said housing, said wiper plate pivotally moveable relative to said mandrel, and an actuator engaging said wiper plate and causing said wiper plate to pivot, said second subassembly moveable relative to said first subassembly.

16. The apparatus of claim 15, wherein said first subassembly further includes an overbender connected to said wiper plate, said overbender pivotally moveable relative to said mandrel and said wiper plate.

17. The apparatus of claim 16, wherein said first subassembly further includes a tray stopper adjustably attached to said overbender.

18. The apparatus of claim 15, wherein said second subassembly further includes an overbender connected to said wiper plate, said overbender pivotally moveable relative to said mandrel and said wiper plate.

19. The apparatus of claim 15, further comprising:

a pinch plate connected to said housing in a position substantially centered between said first and second subassemblies and transversely separated from said mandrel.

20. The apparatus of claim 19, further comprising:

a piston device engaging said pinch plate and causing said plate to move linearly with respect to said mandrel.

21. The apparatus of claim 19, further comprising:

a bow guide connected to said pinch plate, said guide supporting a tray in communication with said wiper plate.

22. The apparatus of claim 15, further comprising:

a tray removably communicating with said first subassembly wiper plate and said second subassembly wiper plate, said tray releasibly retaining an article to be bowed.

23. The apparatus of claim 15, further comprising:

a first mandrel support lock having a receiving cavity, said lock pivotally connected to said first subassembly; and a second mandrel support lock having a receiving cavity, said second lock pivotally connected to said second subassembly, each of said locks having an active station in which the lock extends above a substantially horizontal surface defined by said first subassembly wiper plate and said second subassembly wiper plate and an end of one of said mandrels is received within the lock cavity, and an inactive station in which the lock is positioned at or below said horizontal surface to allow a tray to be placed into and removed from communication with said horizontal surface.

24. The apparatus of claim 15, further comprising:

a first overbender connected to said first subassembly wiper plate, said overbender pivotally moveable relative to said first subassembly mandrel and said first subassembly wiper plate; and a second overbender connected to said second subassembly wiper plate, said second overbender pivotally moveable relative to said second subassembly mandrel and said second subassembly wiper plate.

25. The apparatus of claim 24, further comprising:

a pinch plate connected to said housing in a position substantially centered between said first and second subassemblies and transversely separated from said mandrel; and a piston device engaging said pinch plate and causing said plate to move linearly with respect to said mandrel.

26. The apparatus of claim 24, further comprising:

a first mandrel support lock having a receiving cavity, said lock pivotally connected to said first subassembly; and a second mandrel support lock having a receiving cavity, said second lock pivotally connected to said second subassembly, each of said locks having an active station in which the lock extends above a substantially horizontal surface defined by said first subassembly wiper plate and overbender and said second subassembly wiper plate and overbender and an end of one of said mandrels is received within the lock cavity, and an inactive station in which the lock is positioned at or below said horizontal surface to allow a tray to be placed into and removed from communication with said horizontal surface.

27. The apparatus of claim 26, further comprising:

a pinch plate connected to said housing in a position substantially centered between said first and second subassemblies and transversely separated from said mandrel; and a piston device engaging said pinch plate and causing said plate to move linearly with respect to said mandrel.

28. The apparatus of claim 15, further comprising:

a gear assembly to facilitate said movement of said second subassembly in relation to said first subassembly, said gear assembly including:

(i) a first side rail connected between said first and second subassembly housings;

(ii) a second side rail connected between said first and second subassembly housings;

(iii) a gear rack connected to said first subassembly housing and communicating with said first and second side rails; and (iv) a locking mechanism communicating with said gear rack, said locking mechanism releasibly securing said second subassembly housing in a desired configuration relative to said first subassembly housing and said rails.

29. The apparatus of claim 28, further comprising:

a displacement cylinder connected to said first subassembly housing, said displacement cylinder engaging said gear assembly and causing said second subassembly to move in relation to said first subassembly.

30. A method for bowing a substrate, comprising the steps of:

placing a substrate on a support;

placing the supported substrate between a mandrel and a wiper plate;

causing the supported substrate to conform to a portion of the mandrel;

restraining the substrate in a bowed position within the support: and removing the restrained substrate and its support from engagement with the mandrel.

31. The method of claim 30, further comprising the step of:

rotating an overbender about said mandrel to conform said substrate to a portion of said mandrel.

32. The method of claim 30, further comprising the step of:

treating said substrate to provide increased pliability of said substrate.

33. The method of claim 30, further comprising the step of:

causing a pinch plate to move linearly toward said mandrel.

34. The method of claim 30, further comprising the step of:

allowing the bowed substrate to dry away from engagement with said mandrel.

35. The method of claim 30, wherein the step of causing the supported substrate to conform to a portion of the mandrel further comprises the steps of:

rotating said wiper plate about said mandrel; and rotating an overbender about said mandrel.

36. The method of claim 30, wherein the step of causing the supported substrate to conform to a portion of the mandrel further comprises the steps of:

rotating said wiper plate and an overbender about said mandrel through a first predetermined angle;

causing the rotation of said wiper plate about said mandrel to cease; and further rotating said overbender about said mandrel through a second predetermined angle.

37. A bowing press apparatus, comprising:

a housing;

a mandrel supported by said housing;

a wiper plate assembly connected to said housing and centered adjacent to said mandrel, said wiper plate assembly including a pair of wiper plates each pivotally moveable relative to said mandrel; and an actuator engaging said wiper plate assembly and causing said wiper plates to pivot.

38. The apparatus of claim 37, further comprising:

a pinch plate connected to said housing in a position substantially centered between said wiper plates and transversely separated from said mandrel, said pinch plate linearly moveable relative to said mandrel.

39. A bowing press apparatus, comprising:

a first subassembly including an anterior and posterior housing wall, a mandrel supported by said housing, a wiper plate connected to said housing and pivotally moveable relative to said mandrel, an actuator engaging said wiper plate and causing said wiper plate to pivot, an overbender connected to said wiper plate and pivotally moveable relative to said mandrel and said wiper plate, and an actuating device engaging said overbender and causing said overbender to pivot;

a second subassembly including an anterior and posterior housing wall, a mandrel supported by said housing, a wiper plate connected to said housing and pivotally moveable relative to said mandrel, an actuator engaging said wiper plate and causing said wiper plate to pivot, an overbender connected to said wiper plate and pivotally moveable relative to said mandrel and said wiper plate and an actuating device engaging said overbender and causing said overbender to pivot, said second subassembly moveable relative to said first subassembly;

a pinch plate connected to said housing in a position substantially centered between said first and second subassemblies and transversely separated from said first and second subassembly mandrels;

a piston device engaging said pinch plate and causing said plate to move linearly with respect to said first and second subassembly mandrels;

a substantially horizontal surface defined by said first subassembly wiper plate, said first subassembly overbender, said second subassembly wiper plate and said second subassembly overbender;

a first mandrel support lock having a receiving cavity, said lock pivotally connected to said first subassembly anterior housing wall;

a second mandrel support lock having a receiving cavity, said second lock pivotally connected to said second subassembly anterior housing wall, each of said locks having an active station in which the lock extends above said horizontal surface and an end of one of said mandrels is received within the lock cavity, and an inactive station in which the lock is positioned at or below said horizontal surface to allow a tray to be placed into and removed from communication with said horizontal surface;

a gear assembly including:

(i) a first side rail connected between said first and second subassembly anterior housing walls;

(ii) a second side rail connected between said first and second subassembly posterior housing walls;

(iii) a gear rack transversely connected to said first subassembly anterior and posterior housing walls and communicating with said first and second side rails; and (iv) a locking mechanism connected to said first subassembly anterior housing wall, said locking mechanism releasibly securing said second subassembly housing in a desired position relative to said first subassembly housing and said rails;

a displacement cylinder connected to said first subassembly anterior housing wall, said displacement cylinder engaging said gear rack and causing said second subassembly to move in relation to said first subassembly; and a tray stopper adjustably attached to said first subassembly overbender.

40. A method for bowing a substrate about a first mandrel connected to a first subassembly and a second mandrel connected to a second subassembly, comprising the steps of:

treating a substrate to provide increased pliability of said substrate;

placing said substrate on a support;

placing the supported substrate on a horizontal planar surface of a bow press, said surface defined by a first wiper plate connected to said first subassembly, a second wiper plate connected to said second subassembly, and a pinch plate located between said first and second subassemblies;

engaging a first mandrel lock to secure said first mandrel;

engaging a second mandrel lock to secure said second mandrel;

causing said pinch plate to move linearly toward said first and second mandrels whereby said substrate engages said first and second mandrels;

rotating the first wiper plate about said first mandrel;

rotating the second wiper plate about said second mandrel;

rotating a first overbender connected to said first wiper plate about said first mandrel;

rotating a second overbender connected to said second wiper plate about said second mandrel;

disengaging said first mandrel lock from said first mandrel;

disengaging said second mandrel lock from said second mandrel;

causing said second subassembly to move transversely in relation to said first subassembly to release pressure exerted on said supported substrate; and removing said supported substrate from engagement with said first and second mandrels.

* * * * *